US011280471B2

(12) United States Patent
Cimino

(10) Patent No.: US 11,280,471 B2
(45) Date of Patent: Mar. 22, 2022

(54) LIGHTED ARCHITECTURAL BLOCK SYSTEM

(71) Applicant: Treestone Cimino, Denver, CO (US)

(72) Inventor: Treestone Cimino, Denver, CO (US)

( * ) Notice: Subject to any disclaimer, the term of this patent is extended or adjusted under 35 U.S.C. 154(b) by 0 days.

(21) Appl. No.: 16/723,607

(22) Filed: Dec. 20, 2019

(65) Prior Publication Data

US 2020/0200358 A1 Jun. 25, 2020

Related U.S. Application Data

(60) Provisional application No. 62/784,154, filed on Dec. 21, 2018.

(51) Int. Cl.

| | |
|---|---|
| ***F21V 3/06*** | (2018.01) |
| ***F21V 3/04*** | (2018.01) |
| ***F21K 9/66*** | (2016.01) |
| ***F21S 4/24*** | (2016.01) |

(52) U.S. Cl.

CPC ..... *F21V 3/061* (2018.02); *F21K 9/66* (2016.08); *F21S 4/24* (2016.01); *F21V 3/049* (2013.01)

(58) Field of Classification Search

CPC ..... F21K 9/66; F21V 3/061; E04C 2/546
See application file for complete search history.

(56) References Cited

U.S. PATENT DOCUMENTS

| | | | | |
|---|---|---|---|---|
| 2,216,220 | A | 10/1940 | Baker | |
| 2,281,524 | A | 4/1942 | Meyers | |
| 5,038,542 | A * | 8/1991 | Kline | E04C 1/42 52/306 |
| 6,655,814 | B1 * | 12/2003 | Tagawa | E04C 1/42 362/145 |
| 7,549,784 | B1 * | 6/2009 | Teeters | F21V 23/06 362/145 |
| 7,731,558 | B2 | 6/2010 | Capriola | |
| 8,092,053 | B1 * | 1/2012 | Kopp | F21V 19/005 362/311.02 |
| 8,100,552 | B2 | 1/2012 | Spero | |
| 8,632,198 | B2 | 1/2014 | Ruud et al. | |
| 9,955,551 | B2 | 4/2018 | Spero | |
| 2003/0189820 | A1 * | 10/2003 | Tell | G02B 6/0073 362/602 |
| 2004/0004827 | A1 * | 1/2004 | Guest | G02B 6/0091 362/612 |
| 2006/0227572 | A1 * | 10/2006 | Chen | G02B 6/009 362/633 |
| 2010/0279237 | A1 * | 11/2010 | Farrer | F23D 14/20 431/12 |

(Continued)

FOREIGN PATENT DOCUMENTS

| | | | |
|---|---|---|---|
| CN | 2608602 | Y | 3/2004 |
| CN | 203296294 | U | 11/2013 |

(Continued)

*Primary Examiner* — Jong-Suk (James) Lee
*Assistant Examiner* — Eric T Eide
(74) *Attorney, Agent, or Firm* — Hall Estill Law Firm

(57) ABSTRACT

An architectural block may be arranged with a front face separated from a back face by a border configured with a beveled surface comprising an aperture extending into a space between the front face and the back face. The aperture and beveled surface can each be configured to secure a light strip around the border and a light source of the light strip in the aperture.

20 Claims, 4 Drawing Sheets

(56) References Cited

U.S. PATENT DOCUMENTS

| | | | | |
|---|---|---|---|---|
| 2012/0124926 | A1* | 5/2012 | Kuo | E04C 1/42<br>52/306 |
| 2016/0154171 | A1* | 6/2016 | Kato | F21V 5/00<br>362/606 |

FOREIGN PATENT DOCUMENTS

| | | | |
|---|---|---|---|
| GB | 2442977 | A | 4/2008 |
| KR | 101086004 | B1 | 11/2011 |

* cited by examiner

LIGHTED ARCHITECTURAL BLOCK SYSTEM

RELATED APPLICATION

The present application claims priority to U.S. Provisional Patent Application No. 62/784,154 filed Dec. 21, 2018, the contents of which are hereby incorporated by reference.

SUMMARY

In accordance with some embodiments, an architectural block system can have at least one block with a front face separated from a back face by a border configured with a beveled surface having an aperture extending into a space between the front face and the back face. The aperture and beveled surface are configured to secure a light strip around the border and a light source of the light strip in the aperture.

An architectural block system, in various embodiments, has a front face separated from a back face by a border with each face having a geometric shape having a number of corners. The border is configured with a beveled surface at each of the number of corners to provide a number of apertures extending into a space between the front face and the back face. Each aperture and beveled surface can be configured to secure a light strip around the border and a light source of the light strip in each aperture.

Other embodiments of an architectural block system wrap a first light strip around a border of a first block with the border connecting and separating a front face from a back face. A light source of the first light strip is then positioned in an aperture of the border with the aperture positioned on a beveled surface portion of a corner of the border. The light source is activated to illuminate a space between the front face and the back face.

DETAILED DESCRIPTION

Figure 1:
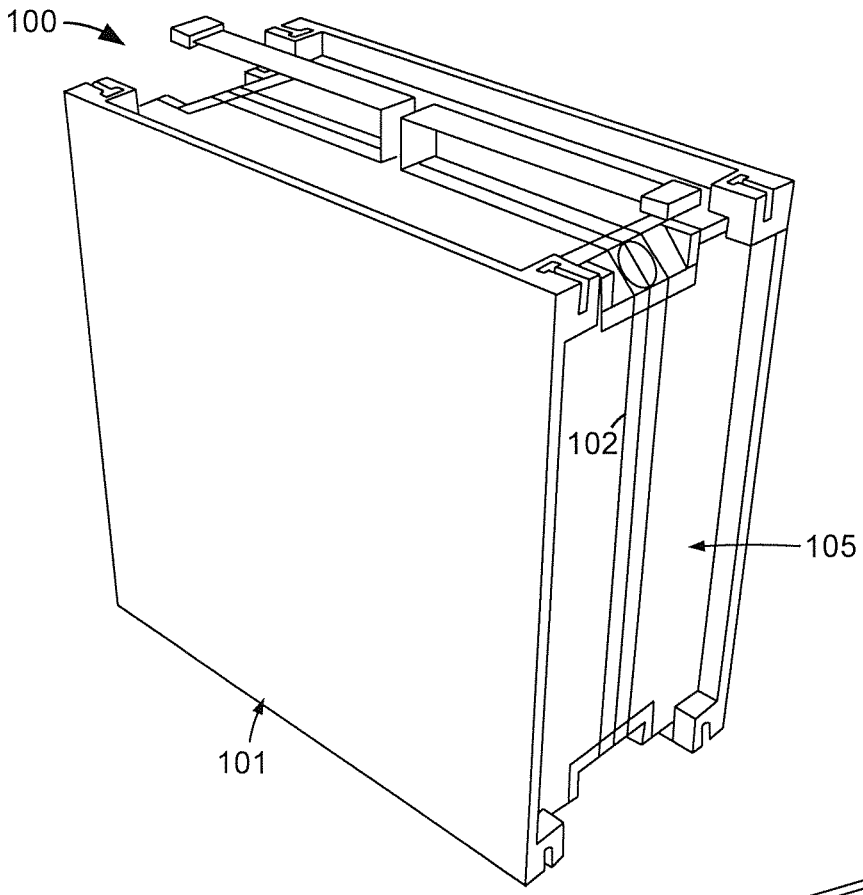
FIG. 1 depicts a side perspective view of an example architectural block in accordance with some embodiments.

Various embodiments described herein are directed to a lighted block with optimized optics and control that can be utilized in a variety of architectural structures.

Historically, transparent tile construction blocks have been used. For instance, glass blocks intended for use with purposes associated with building and architecture. Over time, transparent tile construction blocks have evolved in composition from comprising primarily of glass to comprising other transparent and translucent materials, such as plastic. It is noted that glass blocks have made a resurgence and were often utilized in association with the construction of old homes and remodeling of newer homes. Most recently, the explosion of low cost manufacturing has created a glut of such tiles on the market. Therefore, there remains now a need to repurpose and restyle transparent tile construction blocks in association with new, additional purposes.

It is contemplated to combine lighting sources with transparent tile construction blocks to create new purposes in certain contexts. For example, a LED strip can wrap around an existing glass block. However, such configuration does not result in a directed light emission within the hollow space of a transparent tile construction block, thereby creating a suboptimal dispersion of light within a transparent tile construction block. Alternatively, a translucent glass block can be configured for utilization in flooring and wall applications; however such application requires integration of the light source along the elongated edge of a block, resulting in inefficiencies associated with the circuitry and durability concerns. Moreover, such design does not allow for the repurposing of standard known transparent tile construction blocks for the incorporation of new lighting and associated circuitry into an old design.

Individuals have attempted to integrate controlled LED lights behind transparent tile construction blocks on an ad hoc basis. For instance, a bathroom wall could be made from transparent tile construction blocks featuring wiring housing a multitude of LED adhered behind the transparent tile construction blocks. A customized computer application may control the patterns of the LED lights adhered behind the transparent tile construction blocks. However, the wiring on the exterior of the lights would create a number of disadvantages, such as wiring placed on the outside of the tile poses aesthetic challenges and unprotected wiring is susceptible to snags and other damages caused by unintended interaction with the surrounding environment. Therefore, a problem remaining to be solved is the creation of an integrated wiring housing the lighting in a fashion that is shielded from the surrounding environment. Further, the ad-hoc, unstandardized nature of such a system has disadvantageous challenges associated with the reproducible implementation and usage of such a system.

A variety of glass block technologies may be utilized with construction provide an opaque surface further configured to emit light. In some such configurations, light enters into the sides of the block and only one face of the block component. The other face of the block is obscured. However, a need remains in many circumstances to allow for full transparency in association with the emission of light from within the wall. In another non-limiting example, a translucent channel may surround the narrow sides of a block, allowing only some obstructed light to enter a clear block. In yet, such configuration does not allow for the separation of light entering one block from entering other blocks. Thus, a need remains to allow for unobstructed light to enter a block to better distribute the light and enable a crisper presentation.

It is noted that while a variety of other solutions have been conceived to allow for the protrusion of light into a construction block, no known block arrangement is capable of facilitating interaction to fully harness the advantages of LED technologies. For instance, a luminous brick configured to incorporate a neon gas light does not contemplate external control, change of color or luminosity used in combination with other additional glass blocks, nor does it contemplate such a small light as a LED with a casing able to shield the light emitted into a block from entering other adjacent blocks. Accordingly, a need for a more configurable system able to be used in association with other blocks remains desirable over this and similar technologies.

In an effort to provide a direct light source to a construction block, light is generated at the center of the face of the block to provide a direct light stemming from the center of the block. This type of solution is contemplated for uses in association with lit flooring, for instance in association with disco dance floors. However, a more evenly distributed ambient light source is preferable to solve architectural and design challenges. Other attempts to provide light have configured a construction block with a light source placed within the block itself, as opposed to allowing the light source to shine light into the block from the outside, such as the application of a fiber-optic light source into and within a glass block. In a configuration where the light source exists within the lighted block, the block fails to exhibit the ambient nature desirable in many design and architectural applications.

These and other unmet challenges remain associated with the implementation of lighted transparent tile construction block systems, and therefore a new solution to address such problems remains desirable. With these challenges and issues in mind, various embodiments are directed to an architectural block with at least one beveled corner arranged to facilitate a light strip being wrapped around a channel portion of the block and a light source secured within an aperture of the beveled corner.

Figure 2:
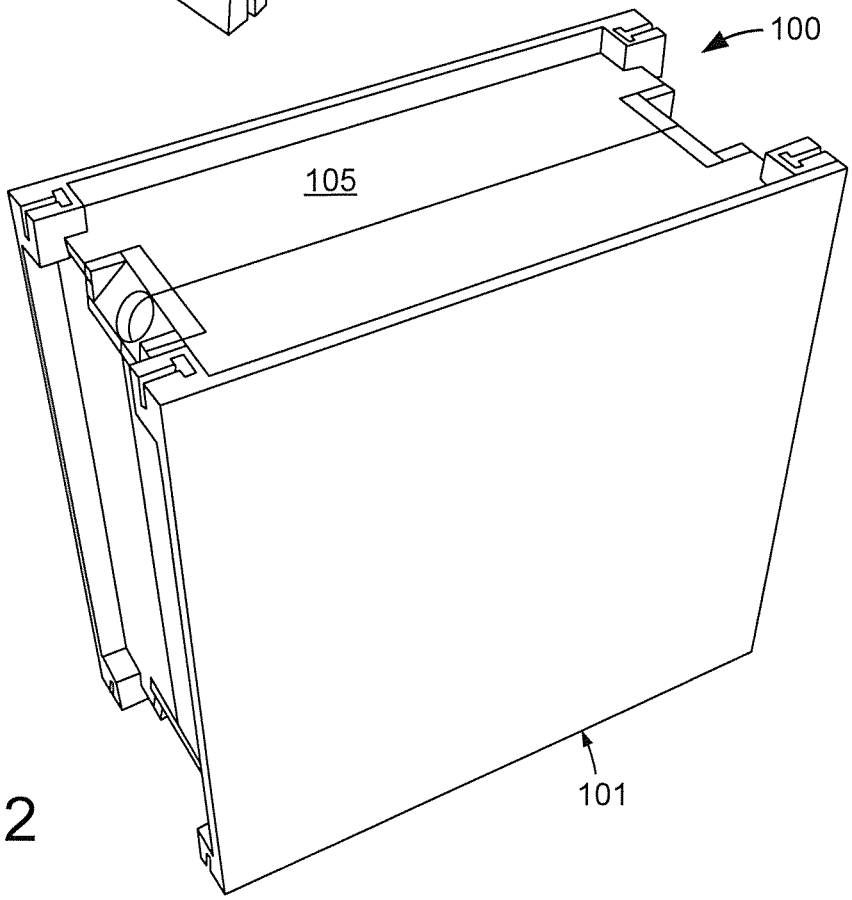
FIG. 2 depicts a top perspective view of an example architectural block in accordance with various embodiments.
Figure 3:
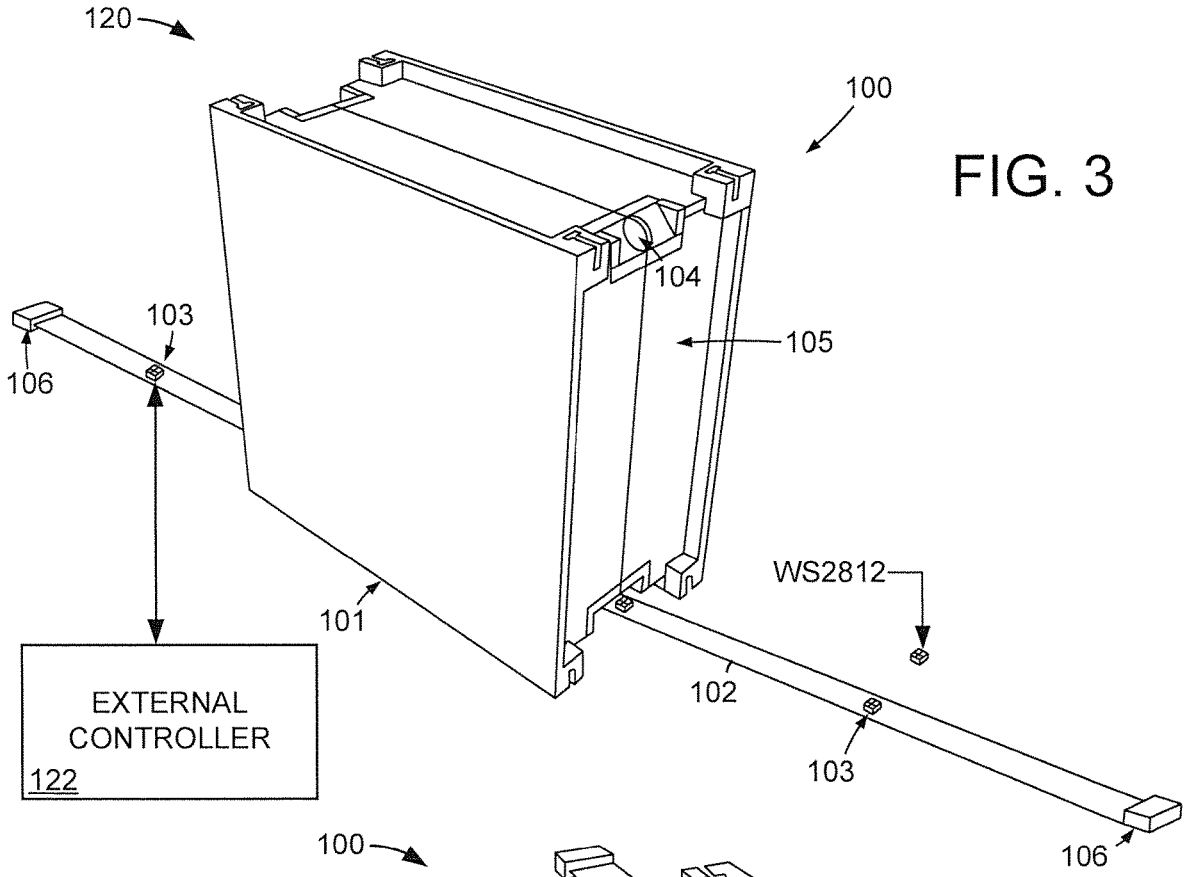
FIG. 3 depicts a side perspective view of an example architectural block system configured in accordance with assorted embodiments.
Figure 4:
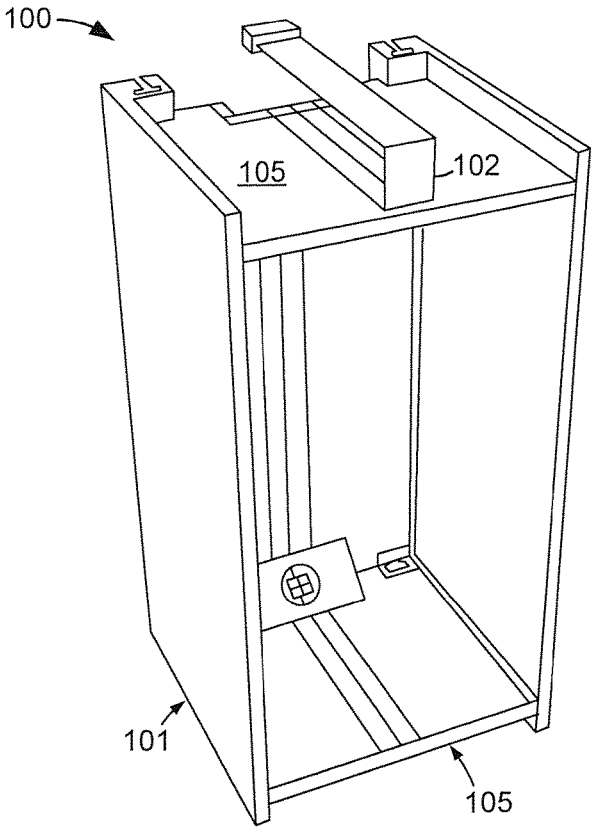
FIG. 4 depicts a cross-sectional view of an example architectural block arranged in accordance with some embodiments.

Turning to the drawings, FIGS. 1, 2, and 4 each depict an example block 100 that can be used in a lighted architectural block system, such as the system 120 shown in FIG. 3. In an embodiment, the architectural block 100 is configured to accept light from external light sources 103 adjacent to or in the immediate vicinity of the architectural block. In an embodiment the light sources 103 are positioned at the corners of the architectural block. The architectural block incorporates light apertures drilled in a beveled region of the corners to facilitate the entry of light generated from the light source 103. In an embodiment, the block 100 utilized comprises a transparent block. In an embodiment, the primary material utilized in the composition of the architectural block 100 is acrylic. In alternative embodiments, the primary material utilized in the composition architectural block is plastic, shatterproof plastic, rubber, glass, or 2-way mirror glass, acrylic or film, or some combination thereof.

In an embodiment, the acrylic block 100 comprises a main face 101 that does not abut other acrylic blocks in the intended configuration. In various embodiments, the main face 101 comprises a texture. In an embodiment, a secondary face on the other, opposite side of the architectural block 100 mirrors the shape and texture of the main face 101. In alternative embodiments, the block 100 comprises a secondary face of a differing shape and/or texture from the main face 101 of the architectural block.

In embodiments, a block border 105 having some depth forms the main structure separating the main face 101 from the secondary face. In an embodiment, the depth of the block border 105 is 3". In alternative embodiments, the depth of the block border 105 is 4", 2" or In an embodiment, the block border 105 is opaque while in other embodiments, the opaque nature of the block border 105 is intended to prevent light from one architectural block from entering into another proximal block. In this way, each individual architectural block 100 when used as part of a system featuring a plurality of architectural blocks 100 can exhibit a discrete, crisp color when lit. In an embodiment, the opacity of the block border 105 is accomplished by the application of white gloss spray paint. In alternative embodiments, the block border 105 comprises a coating of an alternative paint, a rubberized waterproof spray, a tape, or a combination thereof.

In embodiments, the texture of the main face 101 consists of "90 on 90" texture while other embodiments configure the texture of the main face 101 as wavy, icy, or a 50% opacity "haze". In an embodiment, the acrylic block 100 does not incorporate texture, and instead consists of a clear, smooth surface. In embodiments, the at least one light source 103 adjacent to or in close proximity to the architectural block, while shining light through at least one light aperture 104, does not protrude into the architectural block, as depicted in FIG. 4. It is noted that such configuration allows for the architectural block 10 to emit an ambient light that presents light differently than an architectural block incorporating light emitted from a centrally placed source (from within a block). It is further noted that shining light into an architectural block, rather than from within an architectural block, allows the light generated from being blocked from entering other proximal architectural blocks. Hence, the importance of not blocking or obscuring in any way the light emitted from a light source 103 into an architectural block is noted to maintain the crispness of illumination for each architectural block 100 while preventing light from bleeding into other blocks.

In some embodiments, the light apertures 104 are positioned to facilitate the flow of light into the architectural block 100 and not from within the architectural block. It is contemplated that the specific locations chosen for placement of the light apertures 104 can evenly facilitate the flow of light into the architectural block 100 but also to prevent electrical interruptions. An embodiment of the block 100 secures multiple light sources 103 within separate apertures 104 positioned in flat, beveled portions of each corner of the block 100. Such lights 103 of multiple separate blocks 100 can be chained together to be actuated in concert with one another in a system by an external controller 122. In an embodiment, the chaining of the multiple light sources 103 is accomplished by utilization of a light strip 102 featuring a plurality of light sources 103.

While not required or limiting, embodiments configure an architectural block 100 having a rectangular, square shaped a main face 101 with a light strip 102 that comprises four light sources 103. In an embodiment, the light sources 103 are positioned on the light strip 102 so as to line up with the light apertures 104 when the light strip 102 is wrapped around the block border 105 as depicted in FIG. 1, and in position prior to wrapping around the block border 105 as depicted in FIG. 3.

In an embodiment, the light sources 103 consist of LED lights, such as WS 2812 LED lights, UV lights, bright white lights, APA 102 lights, SK 9822 lights, SK 6812 lights, GS 8208 lights. In embodiments, the type of light sources 103 used varies within the same light strip 102. In alternative embodiments, the light strip 102 has a number of light sources 103 corresponding to the number of corners in the shape of the main face 101. For instance, a light strip 102 configured to wrap around a block border 105 of an architectural block comprising a square main face 101 will comprise four light sources 103 while a hexagon main face 101 will comprise six light sources 103 and a triangular main face 101 will comprise three light sources 103, and so on.

In various embodiments, the light sources 103 are positioned at points on the light strip 102 to match up in position with the light apertures 104 and beveled regions of the block border 105 in order to increase the ease of construction while reducing the risk of light strip 102 snagging, moving, shorting, and pinching. In other embodiments, the light strip 102 comprises light sources 103 positioned at specific points on the light strip 102 to line up with the light apertures 104 within the block border 105 upon wrapping of the light strip 102 around the architectural block, regardless of the shape of the main face 101 of the architectural block.

While not required or limiting, each light source 103 may comprise a clear depressed cap of approximately ½' wide and ¼" deep. In such embodiment, the clear depressed cap of each light source 103 is intended for insertion into the light aperture 104, such as to form a hermetic seal. In an embodiment, the light strip 102 is attached to the block border 105 by applying tape, or adhesive to the light strip 102 and the block border 105 following wrapping of the light strip 102 around the block border 105. In alternative embodiments, the light strip 102 is attached to the block border 105 by applying rubberized waterproof tape or heat tape over the light strip 102 and the block border 105 following wrapping of the light strip 102 around the block border 105.

In an alternative embodiment, the light strip 102 is at least partially enclosed within a cartridge. Such a cartridge can make up the block border 105 and eliminate the need for the separate application of tape. Thus, the cartridge may be configured with connection mechanisms 106 to facilitate quick, secure, and reliable electrical connection of one architectural block 100 to another.

It is contemplated that the light strip 102 features connection mechanisms 106 at its ends, or alternatively one connection mechanism at one end. Embodiment can configure the connection mechanisms 106 of JST connectors or 9IP65 plug connectors that can provide waterproof operation, or allow for waterproofing in accordance with processes as well known in the art. The connection mechanisms 106 are specifically configured in an embodiment to facilitate connection to a subsequent light strip 102, a power source, and/or a controller 122. In such a way, any number of light strips 102 are able to be connected in an embodiment to the controller 122. In an embodiment, the light strip 102 each have a light strip 102 address interpretable by the controller 122 to allow for the controller 122 to turn individual light source 103 or individual light strips 102 in the chain on and off. For instance, light strips 102 can each have a light strip 102 address interpretable by the controller 1222 to change the color of each light strip 102 or each individual light source 103.

Figure 7A:
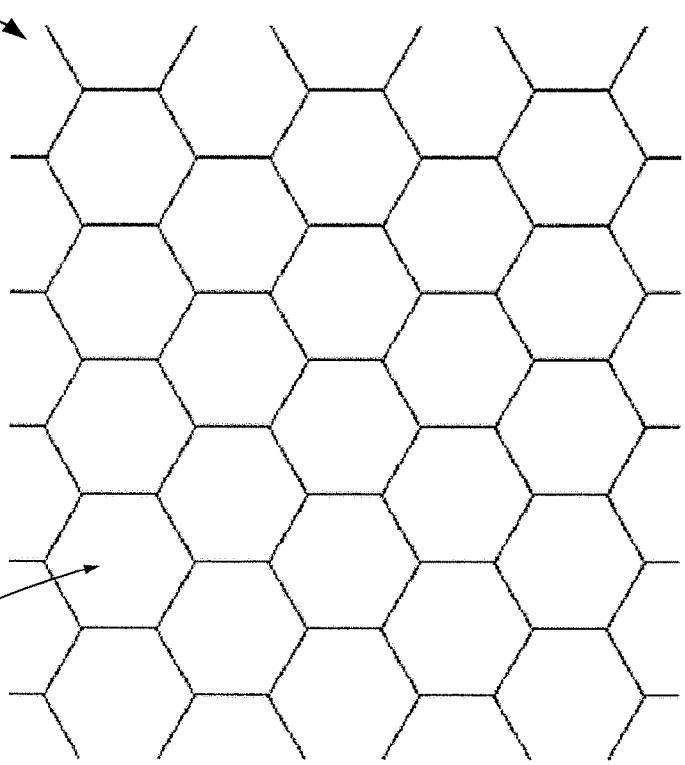
FIGS. 7A and 7B respectively depict example lighted architectural block systems in accordance with some embodiments.
Figure 7B:
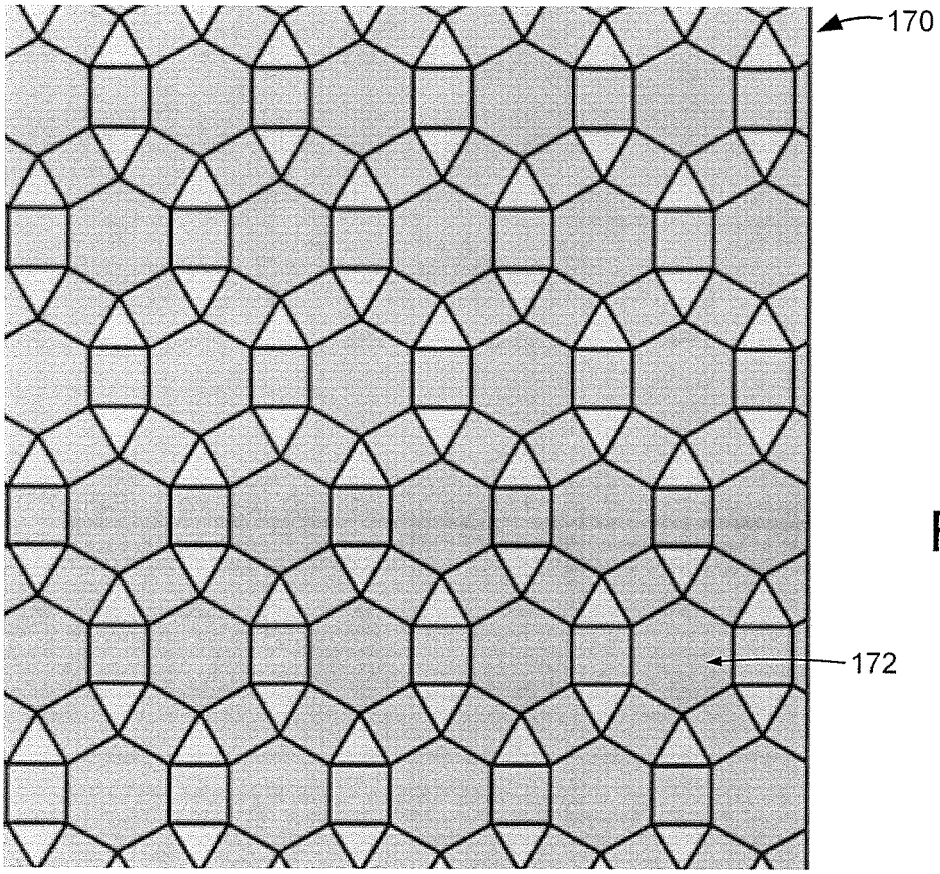

In some embodiments, the main face 101 of the architectural block 100 is square in shape, but other shapes can be used, such as triangle, pentagon, or hexagon shapes. A plurality of architectural blocks 110, in various embodiments, may employ main faces 101 of differing shapes, which may be placed in proximity to one another and connected in such a manner to create a mosaic pattern. Examples of such mosaic patterns are depicted in FIGS. 7A and 7B.

In embodiments where a main face 101 has a square shape, each side of the main face 101 may be 6" in length. Alternative embodiments arrange a main face 101 with each side of a square shaped main face 101 is 8", 4", 3", 2", or 1" in length. However, other shapes can be utilized, such as a triangular, pentagon, or hexagon shaped main face 101 comprising sides in equal length, optionally 3" or 6". It is contemplated that a main face 101 can consist of shapes comprising sides of differing lengths, each length selected from the range of 0.5"-24".

Embodiments may further incorporate a touch sensor. In an embodiment, the touch sensor comprises an electronic sensor configured to detect pressure as well known to those skilled in the art. In an embodiment, the electronic sensor is integrated into an architectural block intended for a person to walk upon. In an embodiment, when the touch sensor detects pressure, the color of the light within the architectural block changes.

An embodiment of a block system may employ one or more a microphone configured to detect a specified range of sound and then actuate a change (optionally of the color) of the light shone into an architectural block 100 following the detection of sound. It is recognized that the particular applicability of embodiments of a lighted block 100 incorporating a microphone configured to detect a specified range of sound and then actuate a change of the color of the light is conducive to environments associated with music and dancing, and in particular for usage as a floor utilized in association with dancing.

An embodiment of a lighted block 100 controls images displayed on a plurality of architectural blocks 100 oriented proximally to one another. For instance, a computer program can be configured to transmit user input to the wall is used to allow a user to engage in the step of inputting a design into the computer program. In an embodiment, the wiring board utilized to facilitate the connection of a plurality of architectural blocks is known to those skilled in the art as "Fade Candy," which optionally is configured to operate on a mobile device, such as an iPad, as well known to those skilled in the art. In embodiments utilizing Fade Candy, the wiring between the architectural blocks, as optionally integrated within each light strip 102, consists of 26 gauge wiring.

Alternative embodiments comprise 22 gauge shielded wiring. Such wiring may facilitate the connection of the plurality of architectural blocks 100 to a controller 122, which optionally consists of a Raspberry Pi device configured to control a plurality of lights. In such embodiments, the Raspberry Pi device is attached with the assistance of a display and camera ribbon with the Raspberry Pi device connected to, and configured to, send instructions to and receive information from any of a the following: a camera, motion sensors, an accelerometer, gravity sensors, a gyroscope, magnetic field sensors, temperature sensors, pressure sensors, or other sensors specific to a particular application of a plurality of the architectural blocks 100.

Various embodiments of the light strips 102, light sources 103, and controller 122 are connected via wire to a power supply, such as Meanwell LRS-350-5, LRS-200-5, SE-600-5, or SE-600-12, with power wire connections facilitated by USB connections and a 110 plug. During a displaying step employing one or more lighted blocks 100, the images input on the mobile device are displayed utilizing the plurality of architectural blocks 100. Optionally, the displaying step facilitates a sequence of images onto the plurality of architectural blocks 100 to create the appearance of an animation. During the displaying step, the images displayed onto the plurality of blocks 100 are optionally chosen from a library of images, which may be facilitated by the Python framework.

In an embodiment, a lighted block system provides the ability for a user to operate a mobile device to capture a photographic image utilizing the mobile device's camera, and then to further display the image in a pixelated form onto the plurality of architectural blocks 100. In some embodiments, a plurality of architectural blocks 100 comprise a system 120/140/150/160/170, whereby the plurality of architectural blocks 100/162/172 are assembled together or otherwise placed in close proximity to one another and connected to each other and to a controller 122. Such system 120/140/150/160/170 is intended for use in association with a variety of contexts. For example, an embodiment of the system 120/140/150/160/170 may be placed on step risers to back light stairs, as shown in FIG. 6, which may have important applications in association with safety.

Figure 5:
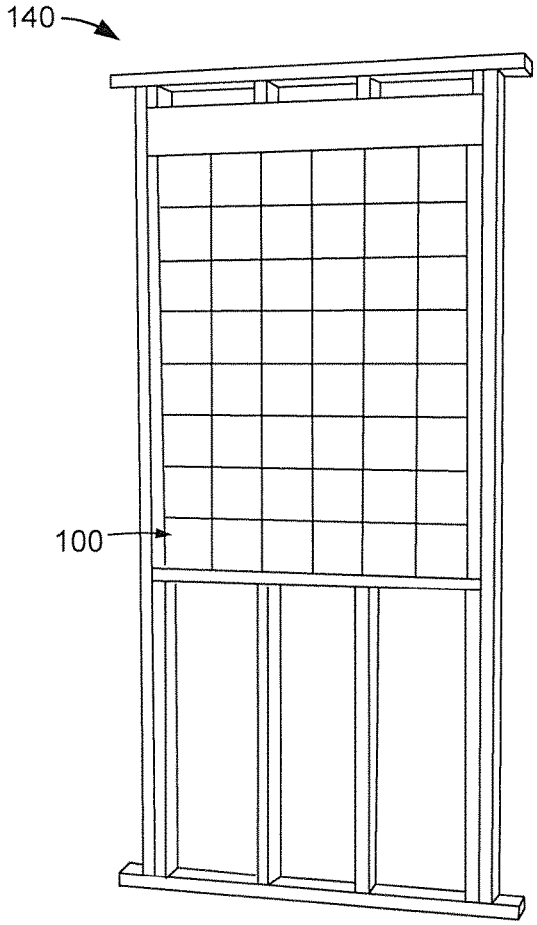
FIG. 5 depicts an example lighted architectural block system constructed and operated in accordance with various embodiments.
Figure 6:
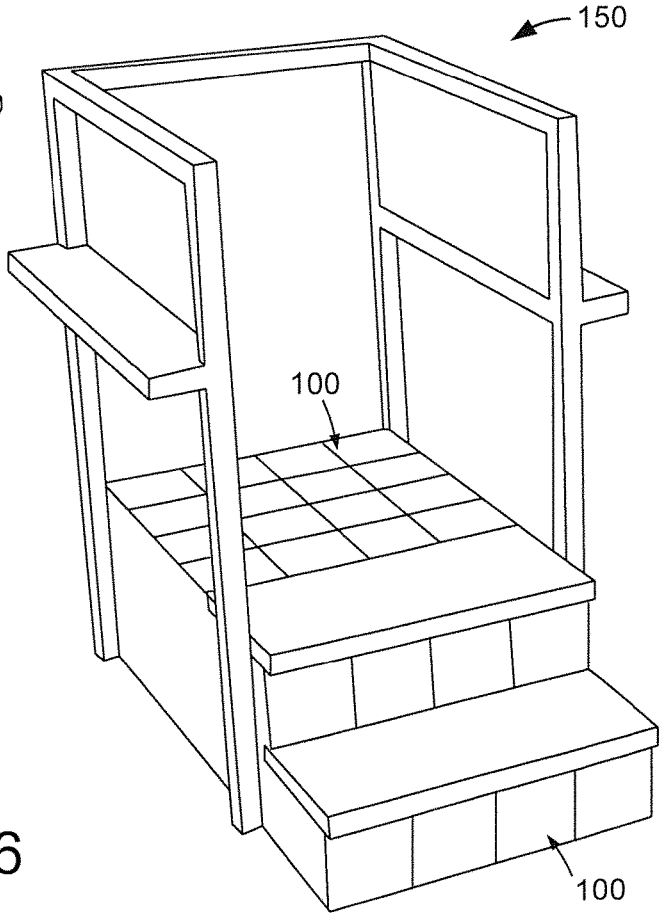
FIG. 6 depicts an example lighted architectural block system configured in accordance with assorted embodiments.

In alternative embodiments, the system 120/140/150/160/170 is utilized in association with a floor, a wall, or step risers for variations of standard architectural purposes, as generally illustrated in FIGS. 5 & 6. In a non-limiting iteration, the system 120/140/150/160/170 is utilized as a dance floor. It is contemplated that a system 120/140/150/160/170 incorporates sensors, optionally pressure, audio, or RFID-related sensors, to allow a for customization of a dance floor surface incorporating the architectural blocks, optionally in association with a communicatively connected smartphone (connected via Bluetooth applications) and an application configured to allow a user to choose a personal dance pattern, colors and other customization options associated with the architectural blocks.

Embodiments of the system 120/140/150/160/170 are configured for standardization of applications. For example, 200 6" wide architectural blocks 100 can be arranged of ten blocks wide by twenty blocks high. In an alternative embodiment, 16 blocks consisting of 4 rows of 4 square architectural blocks 100 can be used to make up a floor. In another embodiment, 6 rows of 4 architectural blocks 100 makes up a window, as depicted in FIG. 5. It is contemplated that 4 square blocks 100 can make up the sides of a lantern, optionally attached to a handle at the top. A row of architectural blocks 100, in some embodiments, is offered as a system 120/140/150/160/170 to provide the back side of a step, offering illumination for safety. In alternative embodiments, architectural blocks 100 are integrated into exterior decking.

In various embodiments, the architectural blocks 100 are configured to allow for the blocks 100 to abut one another. In an embodiment, the block border 105 comprises a cartridge, the cartridge comprising a plurality of male and female clips with the male and female clips configured and positioned in a standard position to allow one architectural block 100 to easily connect to an adjacent architectural block 100. In an alternative embodiment, external clips resembling a three dimensional "H" are utilized to hold an architectural block in place abutting and in relation to one other architectural block 100. It is contemplated that steel wire is utilized to accomplish connection of one or more blocks 100 to an architectural frame. Some embodiments utilize a non-corrosive finished telescoping metal frame to surround the architectural blocks 100 to hold them together. In other embodiments, the architectural blocks 100 are incorporated into standard architectural framing by those skilled in the art utilizing building techniques.

In the foregoing specification, specific embodiments have been described. However, one of ordinary skill in the art appreciates that various modifications and changes can be made without departing from the scope of this disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The terms "coupled" and "linked" as used herein is defined as connected, although not necessarily directly and not necessarily mechanically. A device or structure that is "configured" in a certain way is configured in at least that way, but may also be configured in ways that are not listed. Also, the sequence of steps in a flow diagram or elements in the claims, even when preceded by a letter does not imply or require that sequence.

What is claimed is:

1. A block comprising a front face separated from a back face by a border comprising a first planar surface meeting a second planar surface at a first corner edge, a beveled surface bisecting the first corner edge and comprising an aperture extending into a space between the front face and the back face, the beveled surface extending to less than a length from the front face to the back face to separate a light strip from the first corner edge and secure the light strip around the border, a light source of the light strip secured in the aperture by the light strip, the light source illuminating the space between the front face and the back face.

2. The block of claim 1, wherein the light source is a light emitting diode.

3. The block of claim 1, wherein the beveled surface is recessed into the first corner edge.

4. The block of claim 1, wherein the beveled surface is continuously planar.

5. The block of claim 1, wherein the light source forms a hermetic seal with the aperture of the beveled surface.

6. The block of claim 1, wherein the beveled surface is separated from the front face and the back face.

7. The block of claim 1, wherein the beveled surface extends to connect the first planar surface to the second planar surface.

8. The block of claim 1, wherein the front face has a first non-smooth texture.

9. The block of claim 8, wherein the back face has a second non-smooth texture, the first non-smooth texture being different than the first non-smooth texture.

10. An apparatus comprising a front face separated from a back face by a border, each face having a geometric shape having a number of corners each defined by an edge joint between two planar surfaces, the border comprising a beveled surface at each of the number of corners, each beveled surface bisecting an edge joint, extending to less than a length from the front face to the back face, and comprising an aperture extending into a space between the front face and the back face, each beveled surface separating a light strip from an edge joint and continuously extending around the border, the light strip positioned in each beveled surface to secure a light source of the light strip in each aperture.

11. The apparatus of claim 10, wherein the border is opaque.

12. The apparatus of claim 10, wherein the border continuously extends to physically connect the front face to the back face.

13. The apparatus of claim 10, wherein each face has a square geometric shape.

14. The apparatus of claim 10, wherein each face has a geometric shape with more than four corners.

15. The apparatus of claim 10, wherein each face has a triangular geometric shape.

16. A method comprising:

wrapping a first light strip around a border of a first block, the border connecting and separating a front face from a back face;

positioning a light source of the first light strip in an aperture of the border, the aperture positioned on a beveled surface bisecting a corner of the border, the beveled surface extending to less than a length between the front face and the back face to separate the first light strip from the front face, back face, and an edge of the corner; and activating the light source to illuminate a space between the front face and the back face, the illumination correlated to sound detected by a microphone.

17. The method of claim 16, wherein the first block is attached to a second block as part of a panel, the second block configured with a second light strip positioned to illuminate a hollow cavity in the second block.

18. The method of claim 17, wherein the first light strip and second light strip are each connected to an external controller configured to direct the illumination of the respective first and second blocks with one or more colors.

19. The method of claim 17, wherein the first block is attached to the second block to hide the first and second light strips from view from either the front face or the back face.

20. The method of claim 16, wherein the microphone is used to correlate a first range of sound to a first color illumination of the space between the front face and back face of the first block and a second range of sound to a second color illumination of the space between the front face and back face of the first block.

* * * * *